United States Patent [19]

Ebelt

[11] 4,145,845

[45] Mar. 27, 1979

[54] METHOD AND APPARATUS FOR HONING

[75] Inventor: Günter Ebelt, Westerholt, Fed. Rep. of Germany

[73] Assignee: Maschinenfabrik Glüchauf Beukenberg GmbH, Gelsenkirchen, Fed. Rep. of Germany

[21] Appl. No.: 765,945

[22] Filed: Feb. 7, 1977

[30] Foreign Application Priority Data

Feb. 7, 1976 [DE] Fed. Rep. of Germany ..... 2604858

[51] Int. Cl.[2] ..... B24B 5/08

[52] U.S. Cl. ..... 51/34 F; 51/165.93; 51/349; 51/290; 408/235

[58] Field of Search ..... 51/34 F, 34 H, 34 J, 51/34 K, 165.93, 349, 281 P, 290; 408/129, 235

[56] References Cited

U.S. PATENT DOCUMENTS

| | | | |
|---|---|---|---|
| 2,265,800 | 12/1941 | Connor | 51/349 |
| 2,315,062 | 3/1943 | Kline | 51/349 X |
| 2,315,794 | 4/1943 | Johnson | 51/34 F |
| 2,631,414 | 3/1953 | Muehling | 51/349 X |
| 3,369,327 | 2/1968 | Estabrook | 51/34 J |
| 3,619,956 | 11/1971 | Gehring | 51/349 |

*Primary Examiner*—Gary L. Smith
*Attorney, Agent, or Firm*—Michael J. Striker

[57] ABSTRACT

A recess in a workpiece is honed by a honing tool that is reciprocated in a succession of strokes back and forth in the recess as it is rotated about an axis of the recess. The stones of the honing tool are pressed by at least one hydraulic cylinder against the workpiece with a pressure that is incrementally increased after each stroke. To this end a pilot-controlled primary pressure-limiting valve is connected between a pump and the cylinder, and a plurality of multiway valves can connect any of a plurality of differently preset secondary pressure-limiting valves to the pilot port of the primary valve. The cylinder piston can have a pair of unequal effective faces each exposed in a respective cylinder compartment so that during a first operation stage both compartments are pressurized to the same extent for differential action and during a second operation stage only one of the compartments is pressurized.

11 Claims, 2 Drawing Figures

METHOD AND APPARATUS FOR HONING

CROSS-REFERENCE TO RELATED APPLICATIONS

This application is related to my commonly filed and assigned patent applications Ser. Nos. 765,944, now U.S. Pat. No. 4,094,103 and 765,946, now U.S. Pat. No. 4,109,418 the entire disclosures of which are herewith incorporated by reference.

BACKGROUND OF THE INVENTION

This invention relates to a method of controlling the working pressure of a hydraulic medium delivered by a pump via a remote conrol multiway valve to a thrust piston unit serving at least indirectly to press grinding members of an axially reciprocable and simultaneously rotatable honing tool against the surface of a workpiece recess to be honed during a selectable period.

The invention also relates to an apparatus for carrying out the method including a pump and a remote-controlled multiway valve disposed between the pump and at least one thrust piston unit actuating the axially reciprocable and simultaneously rotatable honing tool.

It is known to radial displace the grinding members of a reciprocal and rotatable honing tool releasably attached to the free end of a hollow honing rod by using a hydraulic thrust piston unit to operate actuating means passing through the honing rod in the longitudinal direction. After the introduction of the honing tool into the recess in the workpiece the thrust piston unit in the known arrangement is always subjected to the full working pressure whose level is mainly determined by the nature of the material to be machined and the thickness of the layer to be removed.

Application of the full pressure to the thrust piston unit when the surface of the recess in the workpiece is still rough and irregular frequently results in jamming of the honing tool in the recess, without the drives for the axial and rotary movements of the honing tool being immediately stopped. As a result the grinding members of the honing tool in particular are subjected to heavy mechanical stress which cause premature wear which may even destroy them. Moreover, worn grinding members give uneven machining of and may damage the workpiece surface. To ensure at least a fairly satisfactory quality of the workpiece surface with the known arrangement, therefore, the grinding members must be changed frequently. However, apart from the considerable expenditure of material, this results in a fairly prolonged duration of machining of each individual workpiece and has very adverse effects on the economics of the honing method.

SUMMARY OF THE INVENTION

It is therefore an object of the invention to provide an improved method and apparatus of the kind specified which ensure the production of a workpiece surface always having the same high quality, accompanied by a longer life of the honing tools and reduced machining time.

Accordingly, in one aspect, the present invention provides a method of controlling the working pressure of a hydraulic medium delivered by a pum via a remote controlled multiway valve to a thrust piston unit serving to press grinding members of a axially reciprocable and simultaneously rotatable honing tool against the surface of a workpiece recess to be honed, which method comprises setting the pressure of the hydraulic medium supplied to the thrust piston unit using a primary controllable pressure-limiting valve, controlling the primary pressure-limiting valve after introduction of the honing tool into the workpiece recess progressively to increase the pressure supplied to the piston unit, for example in steps dependent on the stroke of the tool to a preselectable maximum value corresponding to the pump pressure, and maintaining the supplied pressure at the preselected level during the remaining honing time, while permitting the pressure to be increased to a value exceeding the preselected pressure if necessary.

The thrust piston unit is thus progressively and incrementally actuated so as to increase the contact pressure or abrading force of the grinding members on the workpiece surface from a zero or slight initial pressure continuously to a value which is most favorable in view of the thickness of the surface to be removed and the nature of the material of the workpiece. The slow incremental increase in the grinding member contact pressure enables narrow places in the recess in the workpiece and nonround parts of the surface to be removed with an initially low pressure, without the tool jamming. Only after these irregularities have been removed and the workpiece surface has been equalized is the contact pressure of the grinding members further increased until the preselected working pressure is reached. The preselected working pressures is then maintained until the workpiece surface has been machined to the required extent and the desired surface firmly achieved.

Increase in pressure can be carried out in dependence on the stroke of the honing tool. In this connection, an increase in pressure may be made after each stroke. An increase in pressure may instead be made only after each second or multiple stroke. The rise in pressure can also be initiated manually. However, the rising pressure is preferably initiated automatically during the changeover at the end of the stroke. The slow stepped increase in contact pressure is gentle on the grinding members and lengthens their useful life. Furthermore the surface quality is substantially improved, since a well defined and continuous removal of material is performed by grinding members in prime condition. The machining time is also shortened since the well defined removal of the material enables the freely selectable machining time up to the production of the requdired surface quality to be maintained within relatively narrow tolerances, so that intermediate checks with subsequent honing are eliminated.

The stepped increase of the contact pressure of the grinding members on the workpiece surface of course does not preclude the fact that if required, for instance, with only a very small amount of material to be removed and a workpiece surface suitably prepared, a single pressure level can be deliberately selected which is then maintained over the whole machining period. Moreover, a method embodying the invention does not preclude the fact that the pressure can be briefly raised above the selected working pressure both when increasing the working pressure and also during the machining period with full contact pressure. Such a brief increase may, for instance, be necessary if the workpiece has been honed smooth and no further material is being removed. The brief increase in pressure above the selected working pressure results in the workpiece surface being scored so that the grinding members again come into engagement therewith and remove the material. A method embodying the invention ensures a perfect and uniform geometry of the cross section in each longitudinal zone of the workpiece, more particularly even in workpieces in which the recesses do not pass right through the workpiece as is, for instance, the case with blind bores.

A preferred feature of the method according to the invention is that the hydraulic medium is supplied selectively either exclusively to a piston chamber or simultaneously to the piston chamber and a piston rod chamber of the thrust piston unit. This feature has the advantage that, when the contact pressure of the grinding members on the workpiece surface is increased in steps, the number of pressure stages up to the preselected working pressure is doubled, and therefore a steady increase in pressure can be carried out even more sensitively. This is done in a first stage or mode by increasing the pressure in steps with both the piston chamber and the piston rod chamber pressurized, and then in a second stage or mode by increasing the pressure with only the piston chamber supplied.

The apparatus according to the invention is provided with a pump, and a remote-controlled multiway valve disposed between the pump and at least one thrust piston unit actuating the axially reciprocal and simultaneously rotatable honing tool. A controllable primary pressure-limiting valve is interposed between the pump and the multiway valve, the limiting pressure of the controllable pressure-limiting value being controlled by the pressure of a selected one of a plurality of secondary pressure-limiting valves which have different preset pressure values and are selectable in dependence on the stroke of the honing tool or manually.

The apparatus may use a series of such secondary preset pressure limiting valves whose individual preset pressures are stepped between zero and a maximum value. When selected, each of the secondary pressure-limiting valves produces, in dependence on its individual preset pressure, a corresponding reaction pressure at the pilot part of the primary pressure-limiting valve in the main line between the pump and thrust piston unit and therefore raises the pressure, at first limited by this valve, to the selected level. During the stepped increase in the pressure supplied to the piston unit, for instance, at each changeover of the honing tool from one direction to the other, the valve with the next highest pressure is selected, and the previously selected valve is disconnected, until the preselected working pressure has been reached. This pressure is then maintained for the rest of the machining period whose duration has been preselected. However, by manually selecting the highest pressure stage, the aforedescribed progressive increase in pressure or the maintenance of working pressure can be interrupted and a higher pressure can be briefly applied, for instance, to score the workpiece surface if it has been smoothed prematurely.

According to a preferred embodiment of the invention, the secondary preset pressure-limiting valves are grouped in pairs and each such pair is associated with a remotely controlled multiway valve which is connected to a control or pilot line of the controllable primary pressure-limiting valve. The multiway valves are conveniently connected to an electronic selector circuit controlled from a central control desk. By controlling the electronic selector circuit, the multiway valves can be actuated to select each individual secondary preset pressure-limiting valve to produce the corresponding reaction pressure at the primary controllable pressure limiting valve. Preferably, the electronic selector circuit is controlled by the movements of the honing tool as it makes its stroke. With each changeover operation at the end of the stroke the next higher secondary pressure-limiting valve is switched on and the previously selected one switched off. In that case the associated stepped increase in pressure continues until the required working pressure set by the electronic selector circuit has been reached. The selector circuit then ensures that, after this pressure is reached, there is no further increase in pressure and the grinding members are applied to the workpiece surface under this contact pressure for the rest of the machining period. Depending upon how the thrust piston unit is connected to the pump - i.e., whether only the piston chamber or both the piston chamber and the piston rod chamber are supplied, the selector circuit can be so preset that the pressure is first increased on the basis of the difference between the piston area and the annular area, and then when the last pressure is reached, the multiway valve is changed over to supply the hydraulic medium exclusively to the piston chamber, while at the same time there is a switching back to the first of the secondary preset pressure-limiting valves. The increase in pressure again passes through all the steps until the preselected final pressure is reached.

To enable the thrust piston unit to be actuated independently of the electronic selector circuit, a further remote controlled multiway valve may be interposed between the controllable pressure limiting valve and the first remote controlled multiway valve, such further multiway valve being connected to a shunt line which bypasses the controllable pressure-limiting valve and is connected to the pressure line between the pump and the pressure-limiting valve.

The invention can of course be used to actuate the honing tool even if more than one thrust piston unit is used.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF A PREFERRED EMBODIMENT

Figure 1:
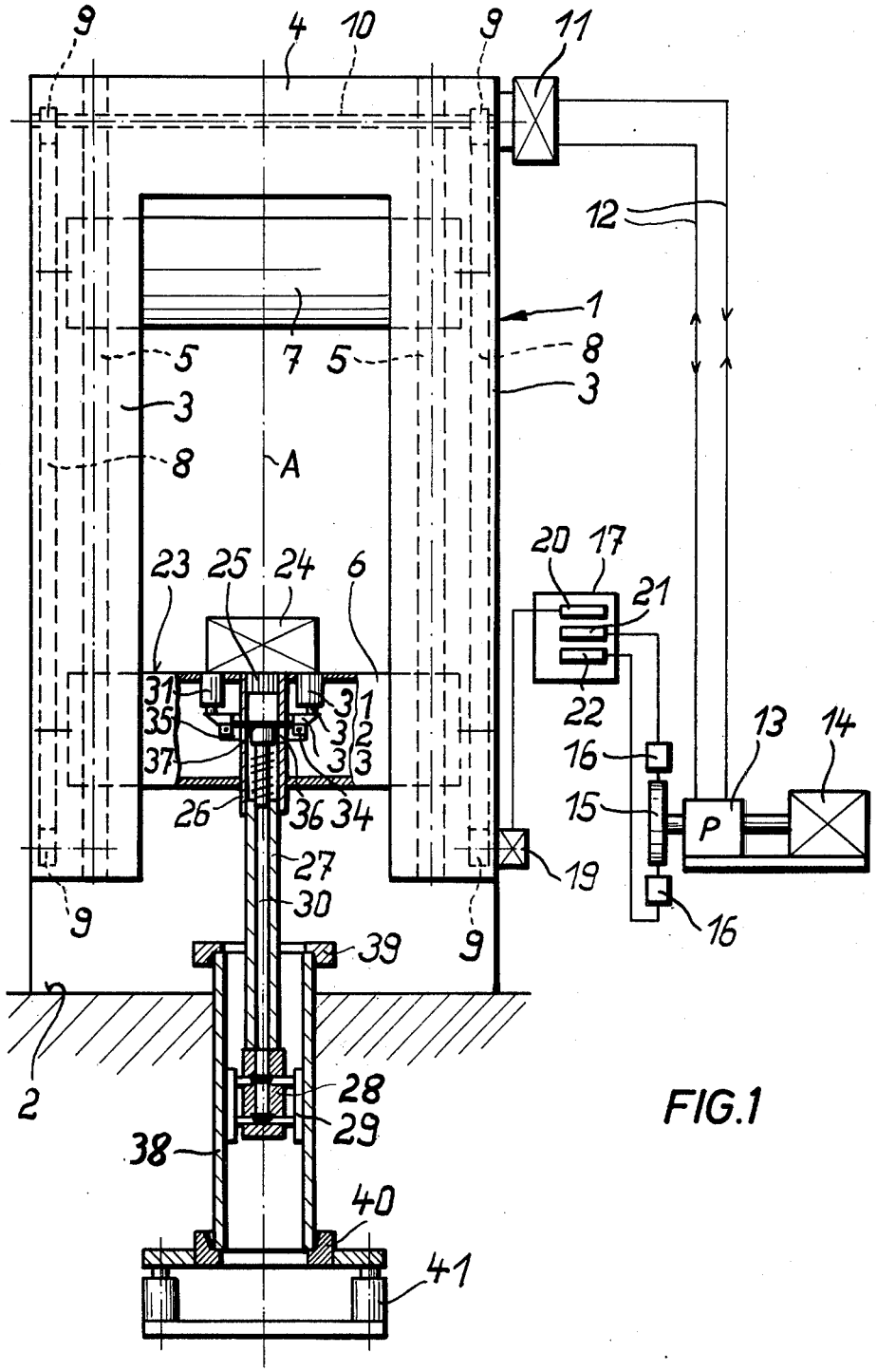
FIG. 1 is a partially schematic partly broken-away side view of the apparatus for carrying out the method of this invention.

FIG. 1 shows a portal-like machine frame 1 which is attached to the floor 2 of a workshop. The frame 1 has two upright and laterally spaced supports 3 and a portal or crosspiece 4 interconnecting the tops of the supports 3 which, like the crosspiece 4, is U-shaped in cross section.

Extending vertically through the channel of each of the lateral supports are two parallel columns 5 disposed one behind the other. The two front columns guide a casing-like cross-member 6, while the two rear columns guide a counterweight 7. The cross-member 6 and the counterweight 7 are moved upwardly and downwardly in opposite directions by means of endless sprocket chains 8 oriented in respective vertical planes in the supports 7. In the top and bottom ends of the supports 3 to the sproket chains 8 each pass over two sprocket wheels 9 spaced apart horizontally one behind the other. The top rear sprocket wheels are disposed on a common shaft 10 driven by a hydrostatic motor 11 connected via fixed hydraulic lines 12 to a controllable hydrostatic pump 13 driven continuously by an electric motor 14. An adjusting device 15 with control heads 16 connected to a controller 17 adjusts, for instance, the pivoting swash plate of a variable axial-piston pump constituting pump 13 to reverse same.

Disposed on the shaft 18 of the bottom front sprocket wheel 9 is a rotation pulse transmitter 19. The pulse emitted by the pulse transmitter 19 are fed to an electronic forward and backward counter 20 of the controller 17 which can be preprogrammed by means of two switches 21 and 22 which determine the two end positions of the cross-members 6 (in dependence on the required stroke length and stroke position). The information of the position of the cross-member communicated to the forward and backward counter 20 is evaluated by the controller 17, which delivers corresponding signals to the control heads 16 of the adjusting device 15 which reverses the pump 13 at the end of each stroke.

Attached to the top 23 of the cross-member 6 is a hydrostatic motor 24 having a drive or output shaft 25 directly connected to a drive sleeve or spindle 26 which is mounted in the cross-member 6 and in which a honing rod 27 can be secured. The honing rod carries at its bottom free end a honing tool 28 having radially displaceable grinding stones or members 29 which are displaced radially by an actuating rod 30 which extends longitudinally through the hollow honing rod 27 and is acted upon by two hydraulically actuatable thrust piston units 31 secured to the cross-member 6. The piston rods 32 of the thrust piston units 31 act on a thrust plate 33 carried on an axial -thrust bearing 34 which is mounted on a flange sleeve 35 and encircles the driving spindle 26 with a sliding clearance. At the level of the flange sleeve 35 the wall of the drive spindle 26 has two slots 36 which are diametrically opposite each other in relation to the spindle longitudinal axis A. A transverse yoke 37 fixed in the walls of the flange 35 passes through the slots and acts on the top end face of the actuating rod 30.

In the embodiment illustrated in FIG. 1 the honing tool 28 is shown in the central longitudinal portion of a tubular workpiece 38 held in a clamping device constituted by two rings 39 and 40. The clamps 39, 40 can be displaced vertically by means of hydraulically operable thrust piston units 41.

Figure 2:
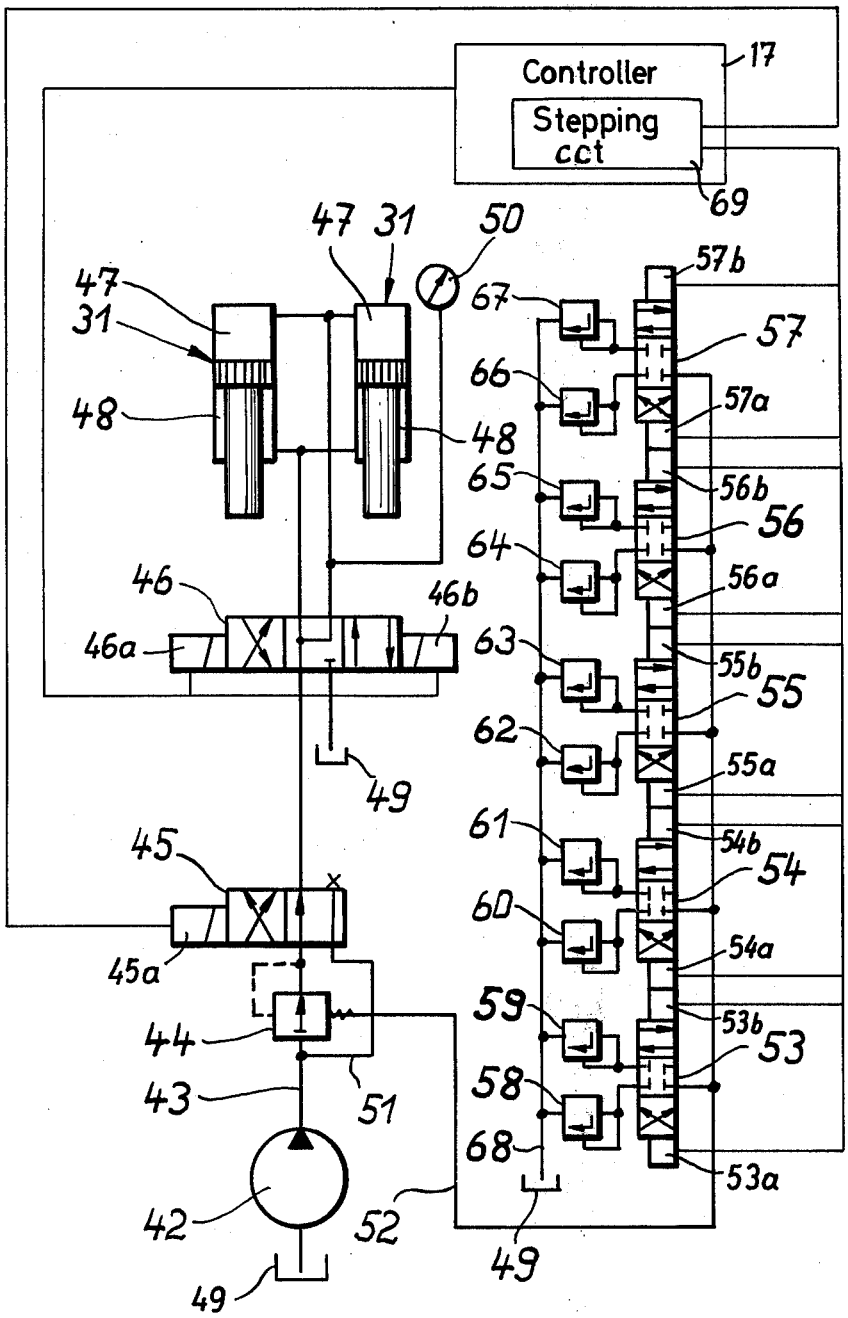
FIG. 2 is a largely schematic view of the control arrangement for the apparatus of FIG. 1.

FIG. 2 shows in greater detail the actuation of the thrust piston units 31 acting on the honing tool 28. The hydraulic medium for the thrust piston units 31 is supplied by a pump 42. Incorporated in the pressure line 43 between the pump 47 and the thrust piston units 31 is a primary controllable pressure-limiting valve 44, followed by an electrically operable 4-port 2-way reversing valve 45. Downstream of the valve 45 is an electrically operable 4-port 3-position valve 46 by means of which the hydraulic liquid is supplied either exclusively to piston chambers 47 of the units 31 or exclusively to piston rod chambers 48 of the units 31, while at the same time each of the other chambers of each unit 31 is connected to a collecting tank 49, or simultaneously to the piston chamber 47 and piston rod chambers 48 of the thrust piston units 31. The pressure in the piston chambers 47 is indicated by a manometer 50.

The two positions of the 4-port 2-way valve 45 enable the hydraulic medium to be transmitted to valve 46 either via the pressure-limiting valve 44 (in the position shown) or directly from the pump output of full pressure. A solenoid 50 which can be energized from the controller 17 operates the valve 45 so that a branch or shunt line 51 connected to the pressure line 43 between the pump 42 and the pressure limiting valve 44 supplies the full pump pressure to the thrust piston units 31 via the valve 46.

A control or pilot line 52 of the pressure-limiting valve 44 is connected to one side of five electrically reversible 4-port 3-position valves 53 - 57 each of which is connected at its other side to two preset secondary pressure-limiting valve 58 - 67 connected in turn to a return line 68 extending to the collecting tank 49. The preset pressure of the pressure-limiting valves 58 - 67 rises uniformly from valve to valve, so that in combination with the differential actuation of the thrust piston units 31 (in the position shown of valve 46) and the sole actuation of the piston chambers 47 twenty pressure values are provided for pressing the grinding members 29 of the honing tool 28 radially against the workpiece 38. To this end the control connections or solenoids 53*a* - 57*b* of the 4-way 3-position valves 53 - 57 and the control connections 46*a* and 46*b* of the multiway valve 46 are connected to an electronic selector circuit of the controller 17.

The apparatus described operates as follows:

After the honing tool 28 has been introduced into the workpiece 38 both the valve 45 and the valve 46 are changed over into the positions illustrated in FIG. 2, their rest positions, so that the piston chambers 47 and piston rod chambers 48 of the thrust piston units 31 are connected via the pressure-limiting valve 44 to the output of the pump 42.

Let us assume that absent pressurization of the pilot port the initial pressure differential of the controllable pressure limiting valve 44 is 3 bars. At the first stroke of the honing tool 28, consequently, the grinding members 29 are forced against the workpiece surface by this pressure, due to the difference between the piston areas and the piston rod areas.

When the end of the stroke is reached, the solenoid 53*b* of the secondary valve 53 is excited via the electronic selector or stepper circuit 69 of controller 17, so that the preset pressure limiting valve 58 is connected to the control line 52. The preset pressure then sets up a reaction pressure at the primary controlled pressure-limiting valve 44 via the control line 52 and thereby increases the pressure in the chamber 47 and 48 of the thrust piston units 31 and therefore the contact pressure of the grinding members 29 during the next stroke.

On completion of this stroke the solenoid 53*a* of the valve 53 is automatically energized via the electronic selector circuit 69 so that the secondary pressure-limiting valve 59 is connected to the control line 52 instead of the pressure-limiting valve 58. Due to the higher preset pressure of the pressure-limiting valve 59, the pressure-limiting valve 44 then again increases the working pressure in the chamber 47 and 48 of the thrust piston units 31 and therefore the contact pressure of the grinding members 29 during the following stroke.

This process continues automatically until, for instance, that preset pressure-limiting valve 65 is reached which corresponds to the required maximum working pressure and which is preselected via the electronic circuit 17 and the valve 56 at the control connection 56. The electronic selector circuit 69 then maintains this maximum pressure until the end of the machining period which is adjustable at the controller 17.

The aforedescribed incremented increase in pressure can therefore take place with the thrust piston units 31 connected in such a way that the piston chambers 47 and piston rod chambers 48 are pressurized simultaneously. However, if a more sensitive increase in pressure than this is to be carried out, first of all the pressure-limiting valves 58 - 67 are successively connected to the pressure-limiting valve 44 in the position shown. After the last valve 67 has been selected via the control connection 57*a* of the secondary valve 57, the valve 46 is changed over via the electronic selector circuit 17 and the control connection 46*a* into that position in which only the piston chambers 47 are connected to the pump 42, pressure-limiting valve 58 being again simultaneously connected via the control connection 53*b* of the 4-port 3-position valve 53 to the control line 52. Then the automatic increase in pressure again passes through each valve up to the preselected pressure stage, but now with only the piston chambers 47 pressurized.

The control system illustrated of course also enables selection at the controller 17 of each of the pressure limiting valve 58 - 67 individually and freely via each control connection of the associated valves 53 - 57, in conjunction with the piston chambers 47 being supplied or the piston chambers 47 and piston rod chambers 48 being differentially supplied. Also during the automatic stepped increase in pressure, for instance, the pressure limiting valve 67 providing the maximum pressure can be briefly selected via the control connection 57*a* of the 4-part 3-position valve 57, to enable the grinding members to score the workpiece surface if it has been smoothed to the extent that the stones 29 slide without abrading.

It will be understood that each of the elements described above, or two or more together, may also find a useful application in other types of grinding systems differing from the types described above.

While the invention has been illustrated and described as embodied in a honing system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for honing a cylindrical recess in a workpiece, said apparatus comprising:

means for holding said workpiece stationary;

a honing tool;

reversible means for displacing said tool back and forth in said recess in a succession of strokes;

means including a cylinder, a piston subdividing said cylinder into a small-area compartment and a large-area compartment, and a piston rod extending from said piston through said small-area compartment and connected to said tool for pressing said tool against said workpiece with an abrading force proportional to the hydraulic pressure effective in said cylinder on said piston;

a mode valve having a pair of output ports each connected to a respective compartment of said cylinder and at least one input port, said mode valve being displaceable between a low-pressure position connecting both of said output ports of said input port and a high-pressure position connecting only said output port of said large-area compartment to said input port;

a source of fluid under pressure connectable to said input port;

means including a plurality of incrementally stepped pressure-limiting pilot valves each connected between said source and said input port for pressurization of said input port at pressures determined by the respective valves; and control means for sequentially connecting said pilot valves between said input port and said source while maintaining said mode valve in said low-pressure position and thereby increasing the pressure in both of said compartments from a relatively low starting pressure to a relatively high limit pressure and for thereafter switching said mode valve to said high-pressure position and again sequentially connecting said pilot valves between said input port and said source and thereby increasing the pressure only in said large-area compartment from said low starting pressure to said high limit pressure.

2. A method of abrading a workpiece with an abrasive tool, comprising the steps of (a) hydraulically pressing said tool against said workpiece by a hydraulic cylinder having a piston with two faces of different areas each associated with a respective pressurizable compartment;

(b) displacing said tool along said workpiece in a succession of strokes while said tool is hydraulically pressed against said workpiece; and (c) increasing the hydraulic pressure effective to press said tool against said workpiece at the moment of reversal of said strokes through a plurality of incrementally increased pressure steps from a predetermined relatively low starting pressure to a predetermined relatively high limit pressure, in a first stage (c') in which both of said compartments are pressurized with the same hydraulic pressure so that only a differential is effective on said tool and in a second stage (c'') in which only one of said compartments is pressurized.

3. The method defined in claim 2 wherein said tool is a honing tool and said workpiece has a recess being honed by said tool, said method further comprising the step (d) of continuously rotating said tool during steps (a) and (b).

4. An apparatus for honing a recess in a workpiece with a honing tool, said apparatus comprising reversible means for displacing said tool back and forth in said recess in a succession of strokes; means including a hydraulically pressurizable cylinder operatively connected to said tool for pressing said tool against said workpiece with an abrading force proportional to the hydraulic pressure in said cylinder, said cylinder having a piston with a pair of faces of different effective surface areas, and a compartment at each of said faces; and control means for periodically increasing said hydraulic pressure at the moment of reversal of said strokes from a predetermined relatively low pressure to a predetermined relatively high pressure through a plurality of incrementally increased pressure steps, said control means including a pump and a plurality of pressure-limiting valves connected between said pump and said cylinder and each set at a predetermined respective pressure different from the pressure of the other valves, and a mode valve displaceable between a first-stage position operatively connecting both of said compartments to said pump and a second-stage position operatively connecting only one of said compartments to said pump.

5. The apparatus defined in claim 4 wherein said control means includes a pilot-controlled primary pressure-limiting valve connectable via said means for connecting to any of said plurality of valves.

6. The apparatus defined in claim 4 wherein said piston has a piston rod extending from said cylinder and operatively connected to said tool, a one of said compartments surrounding said rod.

7. The apparatus defined in claim 4, further comprising means for rotating said tool about an axis while in contact with said workpiece.

8. The apparatus defined in claim 4, further comprising means for momentarily increasing said pressure to a level well above said predetermined level.

9. The apparatus defined in claim 4 wherein said valves are grouped in pairs, said control means including a respective multiway valve for each pair connected on one side to the valves of the respective pair and on the other side between said pump and said cylinder.

10. The apparatus defined in claim 4, further comprising means for pressurizing said cylinder in such a manner that said tool is displaced out of engagement with said workpiece.

11. A method as defined in claim 4, and including the step of briefly and temporarily increasing said pressure pressing said tool against said workpiece beyond said predetermined limit pressure.

* * * * *